United States Patent [19]

Hilbrans et al.

[11] Patent Number: 4,639,269

[45] Date of Patent: Jan. 27, 1987

[54] METHOD AND APPARATUS FOR THE REDUCING TREATMENT OF MOLTEN METALS AND/OR SLAGS THEREOF

[75] Inventors: Hermann Hilbrans, Langenfeld; Michael Gamroth, Cologne; Gerhard Melcher, Cologne; Friedrich Megerle, Cologne, all of Fed. Rep. of Germany

[73] Assignee: Klöckner-Humboldt-Deutz Aktiengesellschaft, Del.X

[21] Appl. No.: 805,805

[22] Filed: Dec. 6, 1985

[30] Foreign Application Priority Data

Dec. 10, 1984 [DE] Fed. Rep. of Germany ..... 3444962

[51] Int. Cl.[4] ..... C22B 15/00

[52] U.S. Cl. ..... 75/76; 75/24; 75/51.5; 75/96; 266/217; 266/225

[58] Field of Search ..... 75/51.5, 24, 76, 96; 266/225, 217

[56] References Cited

U.S. PATENT DOCUMENTS

| | | | |
|---|---|---|---|
| 2,991,173 | 7/1961 | Trentini | 75/51.5 |
| 3,684,539 | 8/1972 | Bartholomew | 75/51.5 |
| 3,900,311 | 8/1975 | Nilles | 75/51.5 |
| 4,329,171 | 5/1982 | Robert | 75/51.5 |

*Primary Examiner*—Peter D. Rosenberg

*Attorney, Agent, or Firm*—Hill, Van Santen, Steadman & Simpson

[57] ABSTRACT

A method and apparatus for reducing molten metals and/or slags thereof which involves top-blowing at least one reduction gas stream wherein fine grained coal or coke particles and injected for covering the surface of the molten metal beyond the blow impression formed by the reduction gas stream. The particles of the stream are at least partially gasified into a carbon monoxide (CO) contained reduction gas stream before they hit the metal surface, so that a mixture of carbon monoxide and coke is blown onto the metal surface together with the reduction gas stream. The coke particles are then radially moved toward the outside of the blow impression at all sides to form a thin veil beyond the perimeter of the blow impressions.

12 Claims, 1 Drawing Figure

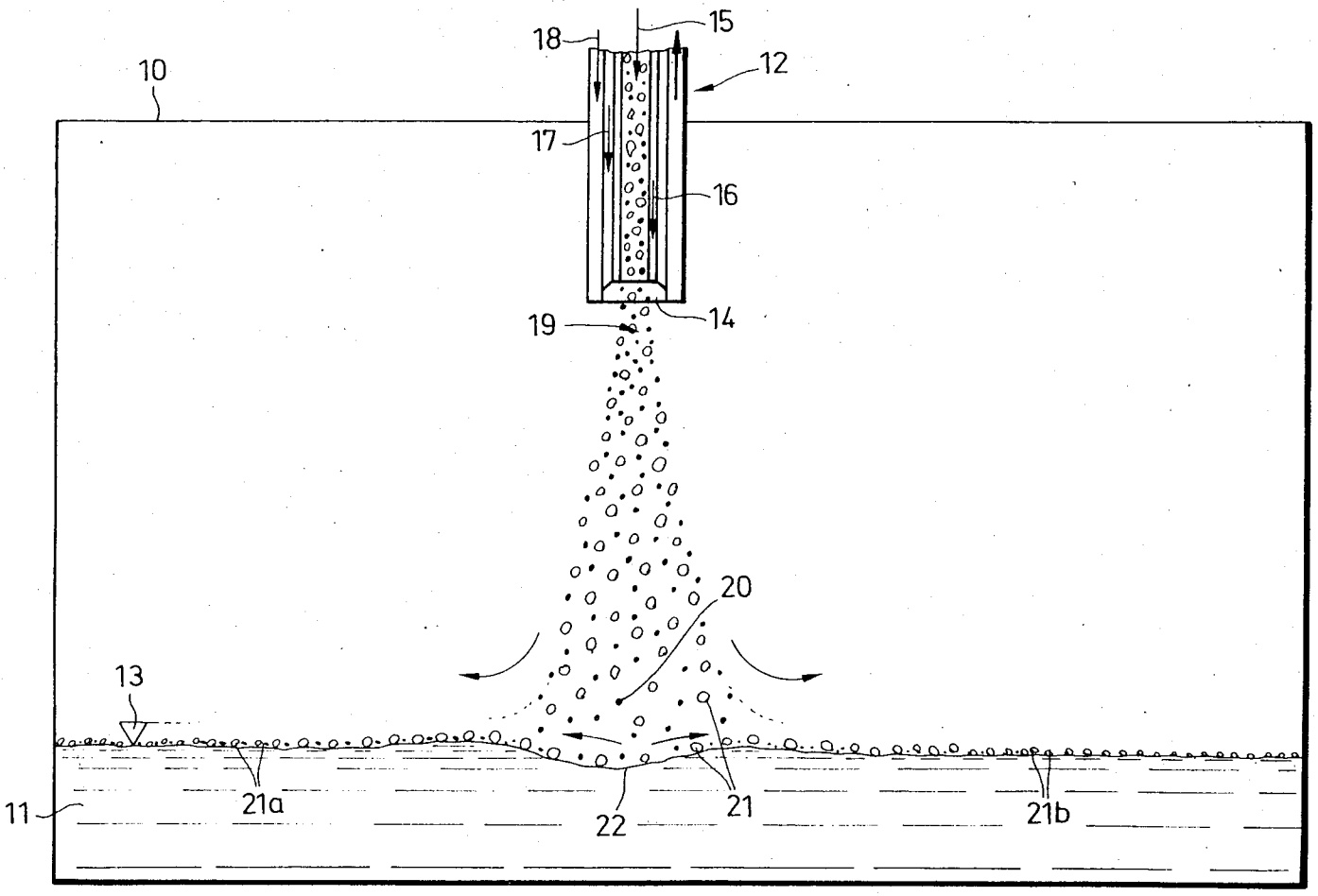
12
15
16
14
18
17
19
20
21
21b
22
21a
10
13
11

METHOD AND APPARATUS FOR THE REDUCING TREATMENT OF MOLTEN METALS AND/OR SLAGS THEREOF

BACKGROUND OF THE INVENTION

1. Field of the Invention

The present invention is in the field of reducing molten metals and/or their slags by top-blowing a reducing stream onto a molten metal bath being treated, and adding finely divided carbonaceous particles about the perimeter of the blow impression created by the reduction gas stream to prevent reoxidation and improve the efficiency of the reduction.

2. Description of the Prior Art

Methods for the continuous or discontinuous reducing treatment of metal melts or of molten slags containing metal oxides utilizing substantially vertical top-blowing of reduction gases for the liberation of the desired metals and/or their compounds by settling and/or volatilization are known. Thus, for example, the German AS No. 26 45 585 (now U.S. Pat. No. 4,210,441, issued July 1, 1980, and whose disclosure is incorporated herein by reference) discloses a system in which reduction gases are blown roughly perpendicularly in the form of focused, high energy gas streams onto the surface of an oxidic slag melt with such a great jet force that a blow impression occurs on the melt surface under every top-blown stream. The blow impression has an approximately toroidal rotating laminar flow of the melt and provides a reaction unit with controlled mass transfer between the blow impression of the melt and the top-blowing stream. High mass transfer rates and reaction kinetic efficiency are improved in comparison with other methods in the region of the blow impression in the melt surface generated by the reduction gas stream.

In such top-blowing of reducing gases onto melts, however, the desired reducing effect is only achieved at the top-blowing location itself and in a tightly limited region adjacent thereto. This region is defined essentially by the blow impression which the gas stream produces in the molten melt. Due to chemical reaction with the melt, the reduction gas has its reduction agent consumed, and its reduction potential decreased as it spreads in the furnace cavity. The ratio of the immediate influencing area of the gas onto the melt to the total melt exposed to the gas space theoretically amounts to at least 1 to 1.4 but as a practical matter amounts to 1 to 3, 1 to 5, or even more.

The used reduction gas together with the gas flowing in due to unavoidable leaking of air into the furnace acts on a very substantial part of the melt to be treated with a weak reduction effect. As a result, a reoxidation of the melt is practically unavoidable on the larger surface presented to the gas space of the treatment furnace in comparison to the reduction effect within the blow impression produced by the gas stream. As a result, a considerable part of the reduction exerted in the blow impression with a high use of reducing agents is lost, due to oxidation processes occurring outside of the blow impression and due to reoxidized melt being agitated back into the blow impression, caused by pulsation of the blowing stream.

The processes cannot be significantly influenced by the material flow within the furnace vessel. At a mass flow of velocity of 1 to 3 m per hour, the rate thereof is 2 to 3 powers of ten lower than the speed of the melt circulating or rotating toroidally in the region of the blow impression.

The reoxidation of the melt beyond the blow impression due to the used gas in the furnace cavity must thus be considered a considerable problem in the successful top-blowing of reduction agents onto a melt. This inadequacy affects all prior proposals for top-blowing of reducing gases or other reduction gases onto melts. It is therefore irrelevant whether, for example, methane, propane, light crude, pyrite or coal are used as reducing agents or as basic materials. In the reducing treatment of melts by means of top-blowing lances, the combustion condition, i.e., the ratio of reducing agent to oxygen, was heretofore viewed as the sole control quantity for the reduction effect or for the reduction potential. This point of view predominated in previous efforts involving top-blowing technology.

SUMMARY OF THE INVENTION

The present invention provides a method and an apparatus for the reducing treatment of molten metals and/or slags thereof using top-blowing technology such that the danger of reoxidation of the melt is avoided, a higher reduction efficiency is achieved, and an improvement in the economic feasibility is achieved overall by means of employing more economical reduction agents.

In the method of the present invention, a reduction gas stream is provided wherein high degrees of heat and mass transfer exist between the gas and the melt with high rates being present in the region of the blow impression, resulting in high reduction efficiencies in that region. At the same time, fine grained coal and/or coke particles for covering the melt surface beyond the perimeter of the blow impression are applied in accordance with the present invention, i.e., they are applied in the environment of the blow impression around the periphery thereof. The coal and/or coke particles to be applied or to be blown onto the melt surface beyond the blow impression can be supplied by means of lance channels or jets which are situated next to the reduction gas stream and are directed to those adjoining regions of the melt surface.

In accordance with a special feature of the present invention, the fine grained coal and/or coke particles to be applied to the melt surface beyond the blow impression are blown onto the melt surface together with the reduction gas stream. The reduction gas stream is generated in such fashion that the coal dust and/or coke dust in amounts less than those stoichiometrically required to react with the carbon present to form carbon monoxide (CO) are mixed with an oxygen-containing gas for the formation of a carbon bearing stream. This stream is blown on and during its transit to the surface of the melt, the particles thereof are at least partially gasified or converted into a CO-containing reduction gas stream before impinging the melt surface. The remaining coal particles during this reaction are transformed substantially into coke by destructive distillation.

In accordance with a further feature of the present invention the coke particles which are generated in the carbon-containing stream are blown onto the melt surface with the reduction gas stream under such conditions that they are moved radially outwardly and delivered toward the outside of the blow impression at all sides into the region outside the blow impression. They are thus moved from the center of the blow impression by the gas stream, float on the melt surface in the region outside of the blow impression, and cover this region relative to the gas space above the melt surface.

The reoxidation of the melt in the furnace to be treated by the reducing jet stream is thereby avoided in accordance with the invention despite top-blowing of a reduction gas stream which causes a pulsation of the melt and agitation at least in the region of blow impression whereby a high reduction efficiency is achieved as viewed over the entire melt surface and a high economic feasibility of the reduction method of the invention is achieved as a result of the employment of coal as a fuel which is more economical than hydrocarbons. It can be said that the reduction efficiency of the reduction method of the present invention is so high that a top-blowing lance operated in accordance with the method of this invention can replace a plurality of top-blowing lances following one another at a distance which only serve to blow reduction gases onto the melt surface, and still provide the same amount of reduction.

One of the important aspects of the present invention is that the particles of the top-blown coal dust and/or coke dust are only partially gasified on their way from the lance nozzle to the melt surface, i.e., they are converted into carbon monoxide. The gasification should not intentionally go to completion; i.e., some but not all of the particles should be converted to CO. The gasification must be controlled such that one part of the particles only are degasified or coked so that the coke particles which have thus arisen float on the melt surface and are available for covering the melt beyond the blow impression where they prevent the further influence of the spent reduction gas and the intrusion of air leaked into the melt and thus prevent undesired reoxidations.

The control of the amount of coke produced in the reaction with the oxygen-containing gas can be achieved in several ways, or in combination of different ways. For example, the coal particles may consist of a mixture of grades of coal, some of which gasify readily and others of which are difficult to gasify. Another means for controlling the amount of coke production involves controlling the flow rate at which the coal is introduced into the particle stream. There is also the possibility of controlling the amount of coke production by diluting the particle stream with an inert gas. Still another means consists of controlling the amount of coke production by control of the grain size range of the coal particles in the particle stream. There is also the possibility of controlling the amount of coke production by selecting coal particles of predetermined volatile and ash contents so that the carbon present is just effective to produce the required amount of coke during the reaction with the oxygen gas.

In specific embodiments of the present invention, coal dust having a non-uniform grain size and a size distribution ranging from about 0.01 to 5 mm, preferably up to 3 mm, can be employed for the formation of the carbon stream. A medium-sized fraction can be sorted out from the granulation spectrum of the coal dust which, for example, can be generated in a suitable coal grinding system, so that only very fine coal particles which gasify readily and coarse coal particles which do not gasify are present. By contrast, when the coal particles employed as a reducing agent are all of the same size from the beginning, they are not gasified but only coked residual coal particles remain before impinging the melt surface.

The surface of the melt must be covered as completely as possible with a more or less dense veil of fine coke particles in order to avoid undesirable reoxidations. The control of the quantity of coke particles depends essentially upon the top-blowing speed, i.e., the available reaction time of the particles during transit from the lance nozzle to the melt surface; the admixture of nitrogen or other inert gases for the purpose of retarding combustion, particularly the employment of air; adjusting the suitable granulation spectrum with fine and coarse particles in the coal dust; and the selection of coal grades with respect to their proportion of volatiles or ash content.

There is also a possibility of constructing the carbonaceous stream leaving the top-blowing nozzle above the melt surface such that the fine coal particles which gasify more readily are concentrated in a core of the stream and the coarse coal particles which do not gasify but rather are coked are concentrated in the outer jacket region of the stream surrounding the core. Covering the melt surface except for the blow impression with coke particles can thus be achieved in this fashion.

The apparatus for carrying out the method may be composed of a top-blowing lance which preferably comprises a plurality of annular conduits concentric with each other. The innermost, central conduit is used for conveying coal and/or coke dust with the suspending gas, and the next annular channel is used for conveying a gaseous hydrocarbon such for example as natural gas, propane, or a reduction gas of the synthesis gas type. The next outer channel is used for conveying oxygen, and the outermost channel consists of a jacket for conveying a cooling agent such as cooling water.

The method of the present invention is employed in a large number of ways, for example, for treatment of slags such as occur in copper metallurgy, lead silicate slags which exist in lead metallurgy, and in the volatilization of zinc or the like which must be subjected to a reducing after-treatment. It is also possible to employ the method of the invention for metal melts which can then be treated with sulfur-free carbon, for example, petroleum coke or charcoal powder. Mixing a plurality of reducing substances such as, for example, pyrite and charcoal makes possible a modification of the method of the present invention. The only requirement for the method of the invention is that a part of the agent top blown onto the surface has a lower density than the melt so that in the form of small, floating particles, this material can protect against reoxidation.

DESCRIPTION OF THE PREFERRED EMBODIMENTS

The invention and its further advantages and features will be set forth in greater detail with reference to the embodiment shown in the single FIGURE of the drawings which represents schematically the interior of a furnace in which the method of the present invention can be practiced.

The drawing illustrates a furnace cavity 10 for the reducing treatment of a molten slag 11 which arises from a process for pyrometallurgical smelting, particularly of nonferrous metal ore concentrates containing valuable metals such, for example, as copper or the like usually present as oxides. There is provided a substantially perpendicular top-blowing lance 12 which projects into the furnace cavity 10, the lance 12 terminating with a nozzle 14 at a distance above the surface 13 of the slag melt 11 on which the reduction is to take place. The top-blowing lance 12 comprises a plurality of concentric, annular conduits of which the innermost, central conduit serves to convey coal and/or coke dust mixed with a suspension gas such, for example, as nitrogen. This mixture is illustrated at reference numeral 15. The next outermost channels serve to convey a hydrocarbon as illustrated by the arrow 16, the hydrocarbon consisting, for example, of natural gas. The arrow 17 has been applied to a passage for conveying oxygen or an oxygen-containing gas and the outermost channel consists of a jacket for conveying a cooling agent such as cooling water. This circulation has been illustrated at reference numeral 18.

The carbon stream 19 is mixed under less than stoichiometric proportions with the oxygen emerging from the orifice of the lance nozzle 14. Typically, the amount of oxygen is, on a molar basis, approximately one-half of the molar concentration of carbon present. A coal dust introduced as indicated by the arrow 15 having a granulation range from about 0.01 to 3 mm is employed for the formation of the carbon stream 19, the fine particles of this coal dust being gasified into a CO-containing reduction gas stream indicated by reference numeral 20 before it impinges on the surface 13 of the slag melt. The coarse coal particles present are not gasified but are only coked by destructive distillation and converted into coke particles 21 which are blown onto the melt surface 13 together with the reduction gas stream 20. As a consequence of the velocity of the gas stream 20, the particles are deflected toward the outside at all sides and delivered radially beyond the periphery of the blow impression 22 which is caused by the jet velocity of the impinging carbon particle-laden stream. Floating coke particles 21*a* and 21*b* cover the melt surface 13 and protect it against reoxidation from the gas space above the melt whereby the reduction potential can be maintained at the required level over the entire surface of the melt being treated. The ash from the coal which remains in the gasification of the coal particles to form the CO-containing reduction gas melts and enters into the slag of the melt to be treated. With the method of this invention, the gasification products and the degasification products of the coal dust employed are available in their nascent condition for performing the work of reduction. The carbon of the coke particles 21*a*, 21*b* which float on the metal surface 13 contribute to the reduction of the oxidic slag melt 11.

The method of the invention was used in a pilot system with the following parameters. The analysis of the coal dust used in the top-blowing lance 12 was as follows:

$C_{fixed}$ (Carbon)=56.7%
Volatile Components=27.6%
Ash=15.7%
S (Sulfur)=0.8%
Minimum Calorific Value=6,313 kcal/kg Coal dust comprising this analysis and having a grain size from 0.01 to 3 mm was supplied into the central channel of the top-blowing lance 12 with 0.00833 $m^3$/sec of nitrogen or air used as the conveying gas. Oxygen was introduced as indicated by the arrow 17 in sub-stoichiometric proportions (about one-half mol per mol of carbon) at a pressure of 0.5 to 1.0 bar above atmospheric pressure. The coal dust was accelerated by the highly accelerated oxygen stream and the exit speed of the resultant carbon stream 19 was about 330 m/sec, thereby suppressing the danger of a backfire. Natural gas was introduced as indicated by the arrow 16 and was used only to ignite the carbon stream 19. The top-blowing lance 12 which was adjustable in height was 1,600 mm long with an outside diameter of 120 mm. The lance nozzle 14 was spaced from the melt surface 13 by a distance ranging from 500 to 900 mm.

The following agents in the following quantities were supplied to the top-blowing lance 12:

Natural gas for ignition—10–30 $Nm^3$/hr.
Oxygen—100–150 $Nm^3$/hr.
Cooling water—1.5–2.0 $m^3$/hr.
Temperature of stream—1350°–1400° C.

A relatively high reduction efficiency was achieved despite a relatively low specific reduction agent consumption, i.e., kg of reduction agent (coal dust) per metric ton of melt. This is illustrated in the following table:

| | Conventional Natural Gas Top-Blowing Lances | Coal Dust Top-Blowing Lance of the Invention |
|---|---|---|
| Supply of Reduction Gas Per t of Melt | 190 $Nm^3$ Natural Gas (Minimum Calorific Value 9,100 kcal/$Nm^3$) | 216 kg Coal having analysis previously given |
| Volatilized Quantity of Zinc | 51.4 kg Zn Per Ton of Melt | 65.4 kg Zn Per Ton of Melt |
| Specific Consumption of Reduction Agent | 3.67 $Nm^3$ Natural Gas Per kg $Zn_{volatilized}$ | 3.3 kg of Coal Per kg $Zn_{volatilized}$ |
| Minimum Calorific Value of the Reduction Agent Consumed | 33,397 Kcal Per kg of $Zn_{volatilized}$ | 20,850 Kcal Per kg of $Zn_{volatilized}$ |
| Number of Lances | 4 | 1 |

The present invention thus provides a highly efficient means for improving top-blowing of metals and metal slags, while significantly reducing the cost of the operation.

It will be evident that various modifications can be made to the described embodiments without departing from the scope of the present invention.

We claim as our invention:

1. A method for reducing molten material comprising metals or slags which comprises:

providing a confined molten bath of said material, blowing a high velocity reduction gas stream onto the surface of said molten bath to provide a blow impression therein, said reduction gas stream including coal or coke particles in an oxygen containing gas, the amount of oxygen containing gas being less than that required to convert said coal or coke completely to CO, thereby providing a reduction gas stream consisting partly of non-gasified coal or coke particles and partly of a CO containing gas, and depositing said non-gasified coal or coke particles onto the surface of said melt outside the perimeter of said blow impression to inhibit reoxidation of said melt.

2. A method according to claim 1 which comprises:

blowing the coke particles in said CO-containing stream toward the center of said blow impression, whereby the particles are moved radially outwardly from said blow impression.

3. A method according to claim 1 wherein said particles are coal particles consisting of a mixture of grades of coal, some of which gasify readily and others of which are difficult to gasify.

4. A method according to claim 1 which includes the step of directing a hydrocarbon gas stream at said blow impression together with said CO-containing mixture.

5. A method according to claim 4 wherein said hydrocarbon gas is natural gas.

6. A method according to claim 4 wherein said hydrocarbon gas is propane.

7. A method according to claim 4 wherein said hydrocarbon gas is a reduction gas.

8. A method according to claim 1 which comprises: controlling the amount of coke production by controlling the flow rate at which the coal is introduced into said particle stream.

9. A method according to claim 1 which comprises: controlling the amount of coke production by diluting the particle stream with an inert gas.

10. A method according to claim 1 which comprises: controlling the amount of coke production by control of the grain size range of coal particles in said particle stream.

11. A method according to claim 1 which comprises: controlling the amount of coke production by selecting coal particles of predetermined volatiles and ash content sufficient to provide the required amount of coke during said reacting.

12. A method according to claim 1 wherein said reduction gas stream consists of a core of relatively fine grained coal particles which are gasified during said reacting and an outer annular jacket of coarse coal particles about said core which are not gasified during said reacting.

* * * * *